US005921812A

United States Patent [19]

Choy

[11] Patent Number: 5,921,812

[45] Date of Patent: Jul. 13, 1999

[54] SYSTEM FOR MOUNTING TWO CONNECTORS ON TWO SIDES OF BOARD

[75] Inventor: Edmond Choy, Union City, Calif.

[73] Assignee: Hon Hai Precision Ind. Co., Ltd., Taipei Hsien, Taiwan

[21] Appl. No.: 08/850,266

[22] Filed: May 3, 1997

[51] Int. Cl.[6] ..... H01R 13/73

[52] U.S. Cl. ..... 439/567

[58] Field of Search ..... 439/567, 571–573, 439/554

[56] References Cited

U.S. PATENT DOCUMENTS

| | | | |
|---|---|---|---|
| 4,173,387 | 11/1979 | Zell | 439/567 |
| 4,363,530 | 12/1982 | Verhoeven | 439/571 |
| 5,080,611 | 1/1992 | Hypes | 439/567 |
| 5,230,638 | 7/1993 | DiViesti | 439/567 |
| 5,254,016 | 10/1993 | Ganthier | 439/567 |
| 5,336,111 | 8/1994 | Thrush et al. | 439/567 |
| 5,482,474 | 1/1996 | Yohn et al. | 439/567 |
| 5,634,810 | 6/1997 | Niitsu et al. | 439/567 |
| 5,697,812 | 12/1997 | Sampson et al. | 439/567 |

*Primary Examiner*—Gary Paumen

[57] ABSTRACT

An electrical connector assembly (10) includes a pair of identical connectors (12) wherein each connector (12) includes an elongated housing (14) defining a first and a second side wall (15, 17) with a plurality of surface mount type contacts (19) thereon. At least two boardlocks (27, 28) respectively extend downward from the housing (14). The leg devices of such boardlocks (27, 28) are not located on the center line of the housing wherein the leg device of one boardlock (27) is close to the first side wall (15) and the leg device of the other boardlock (28) is close to the second wall (17). The PC board (100) includes at least two pairs of holes (106, 106', 108, 108') in the predetermined area which is used for mounting the connectors (12) thereto. Therefore, when these two connectors (12) are mounted to the predetermined area from two opposite sides, the leg device of one boardlock (27) adjacent the first side (15) of the second lower connector (12) can be received in the first hole (106) of the first pair of holes (106, 106') in the PC board (100), and the leg device of one boardlock (27) adjacent the first side (15) of the first upper connector (12) can be received within the second hole (106') of the first pair of holes (106, 106') in the PC board (100). The other boardlock (28) of the first upper connector (12) and of the second lower connectors (12) perform the same arrangement within a second pair of holes (108, 108') in the PC board (100), respectively.

10 Claims, 6 Drawing Sheets

SYSTEM FOR MOUNTING TWO CONNECTORS ON TWO SIDES OF BOARD

BACKGROUND OF THE INVENTION

1. Field of the Invention

The invention relates to an arrangement for mounting two identical connectors to two opposite sides of a PC board, wherein each connector comprises at least one boardlock for retainable reception within a corresponding hole in the PC board.

2. The Related Art

SMT (Surface Mount Technology) is popularly used in the computer field in place of a through-hole process for mounting an electrical component on the PC board, and thus it is possible to mount the components on both sides (surfaces) of the PC board. To ease the design of the circuit layout on the PC board, it is desired to have the same connectors respectively on the same regions on two opposite sides of the PC board. As understood, the connector having the surface mount contact tails, generally requires the conventional through hole boardlocks for reinforcing retention of the whole connector on the PC board because the surface mount retention pad can not efficiently resist the bending moment occurring during loading/unloading the corresponding module into/from the connector housing. This concern is specially significant when the connector is adapted to receive a larger dimensioned module therein. The DIMM (Dual In-line Memory Module) connector is of this category.

Unfortunately, using the through hole type boardlocks on the connector may bring about interference when the two identical connectors are intended to be mounted on the same location from two opposite sides of the PC board wherein the boardlocks of two different opposite connectors sharing one same hole.

Therefore, an object of the invention is to provide an arrangement on the connector and/or the PC board so as to avoid any improper interference occurring therebetween while still keeping efficient retention of the connector on the PC board.

SUMMARY OF THE INVENTION

According to an aspect of the invention, an electrical connector assembly includes a pair of identical connectors wherein each connector includes an elongated housing defining a first and a second side wall with a plurality of surface mount type contacts thereon. At least two boardlocks respectively extend downward from the housing. The leg devices of such boardlocks are not located on the center line of the housing wherein the leg device of one boardlock is close to the first side wall and the leg device of the other boardlock is close to the second wall. The PC board includes at least two pairs of holes in the predetermined area which is used for mounting the connectors thereto. Therefore, when these two connectors are mounted to the predetermined area from two opposite sides, the leg device of one boardlock adjacent the first side of the first connector can be received in the first hole of the first pair of holes in the PC board, and the leg device of one boardlock adjacent the first side of the second connector can be received within the second hole of the first pair of holes in the PC board. The other boardlocks of the first connector and of the second connectors which are close to the second sides thereof perform the same arrangement within a second pair of holes in the PC board, respectively.

DETAILED DESCRIPTION OF THE PREFERRED EMBODIMENTS

Figure 1:
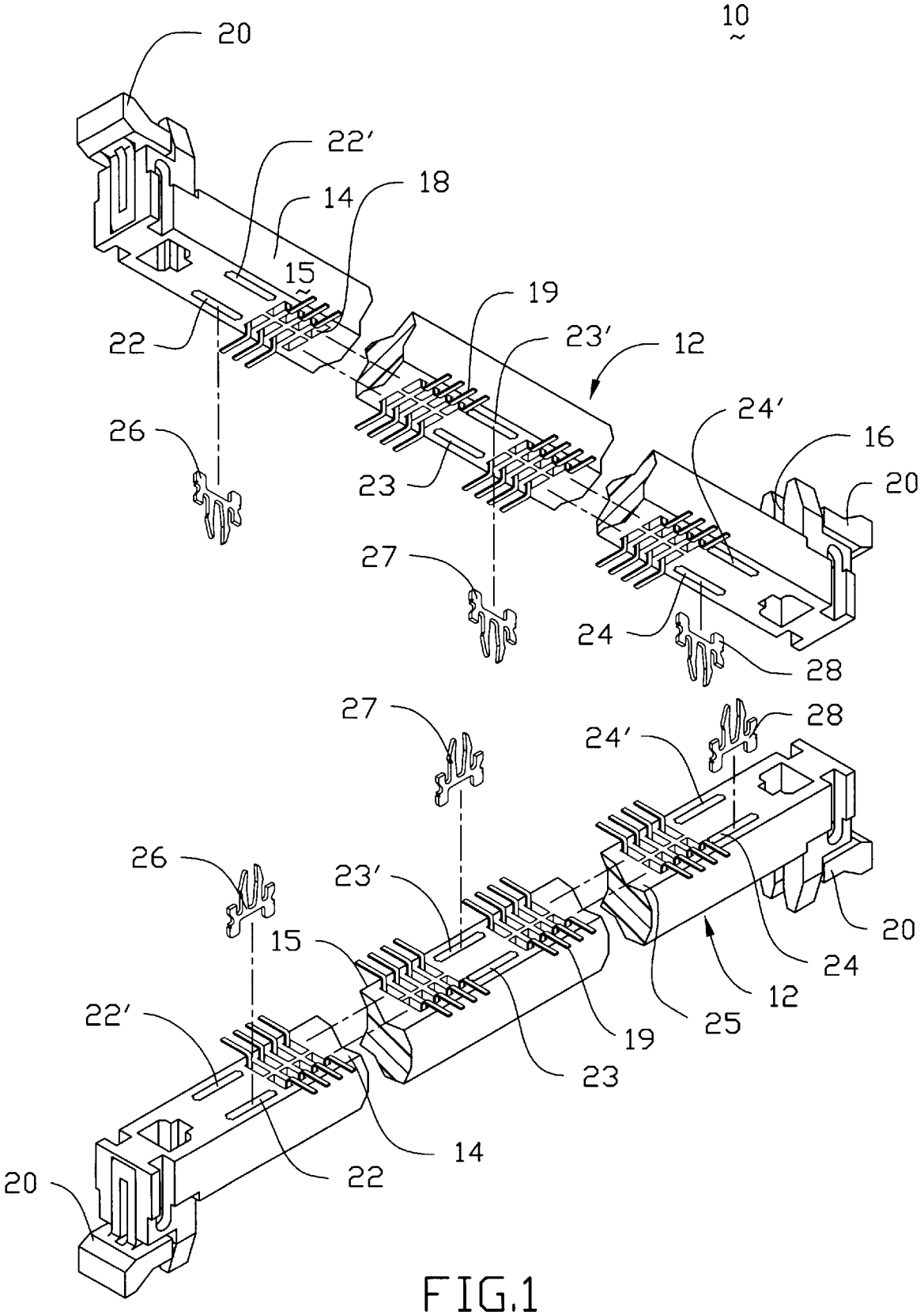
FIG. 1 is an exploded perspective view of a presently preferred embodiment of two opposite connectors adapted to be mounted to the two opposite surfaces of the same area of one PC board sandwiched between these two connector.
Figure 2:
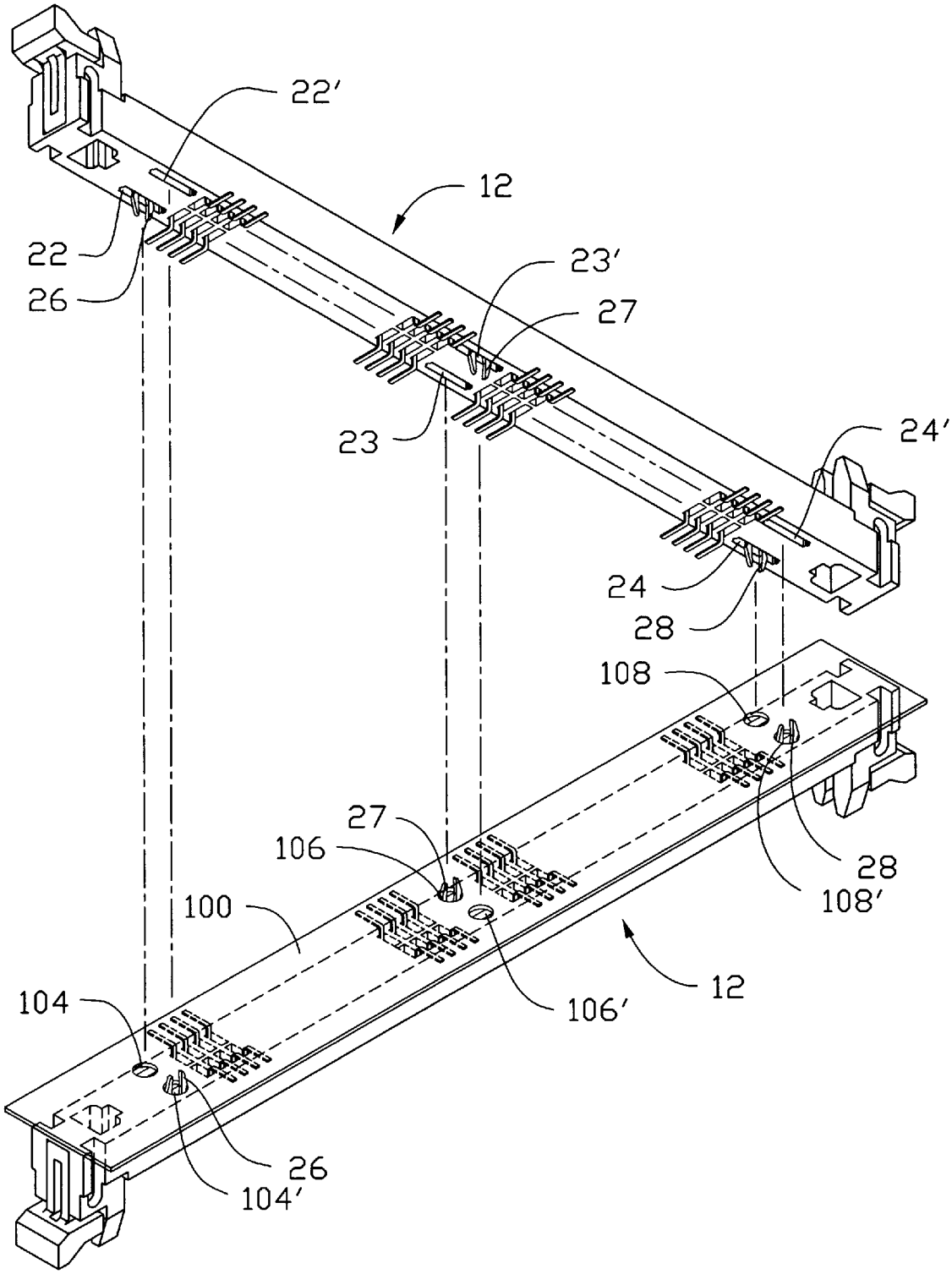
FIG. 2 is a perspective view of the connectors of FIG. 1 with a PC board attached to the lower connector but spaced from the upper connector.
Figure 3:
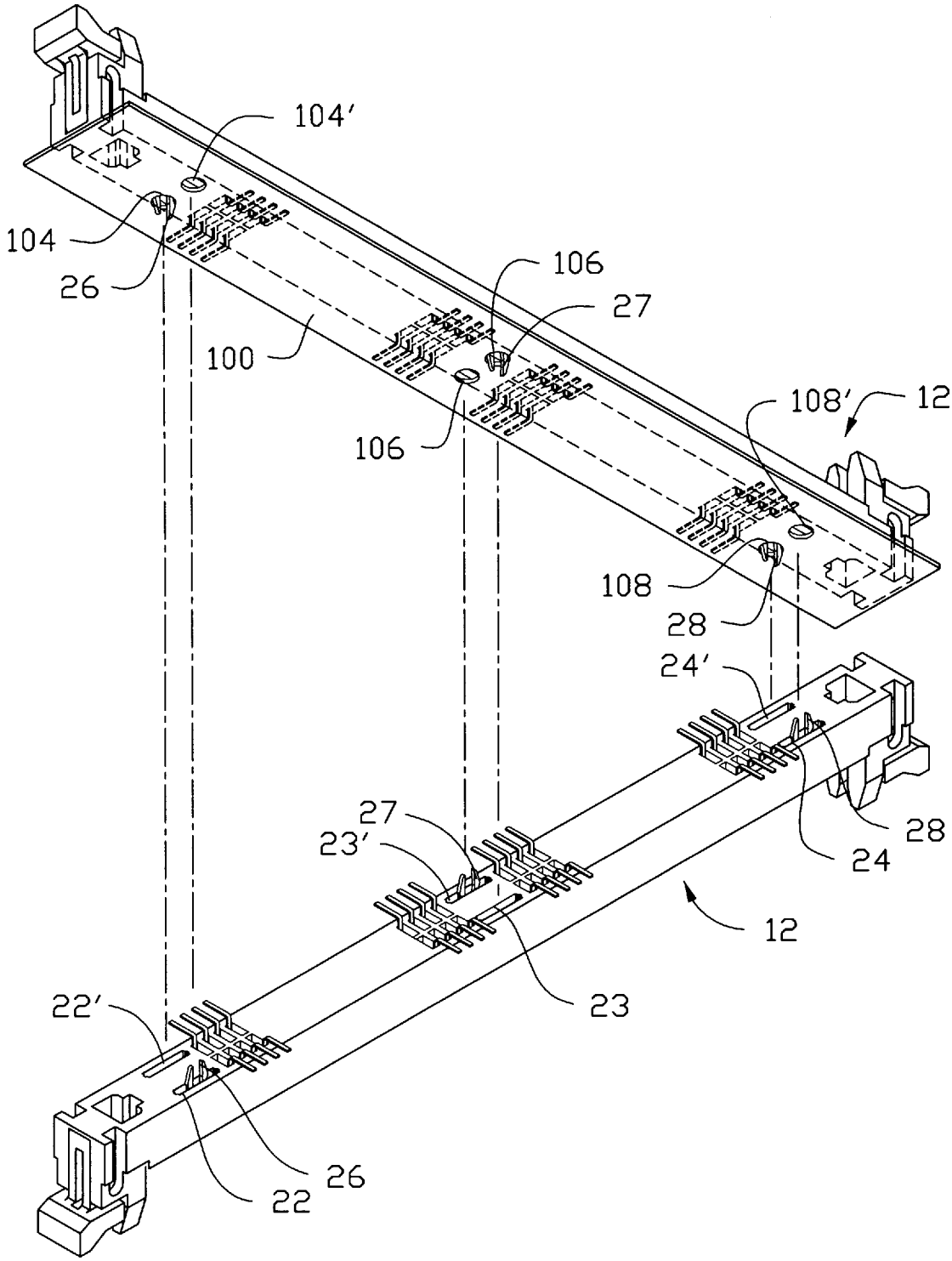
FIG. 3 is a perspective view of the connectors of FIG. 1 with a PC board attached to the upper connector but spaced from the lower connector.
Figure 4:
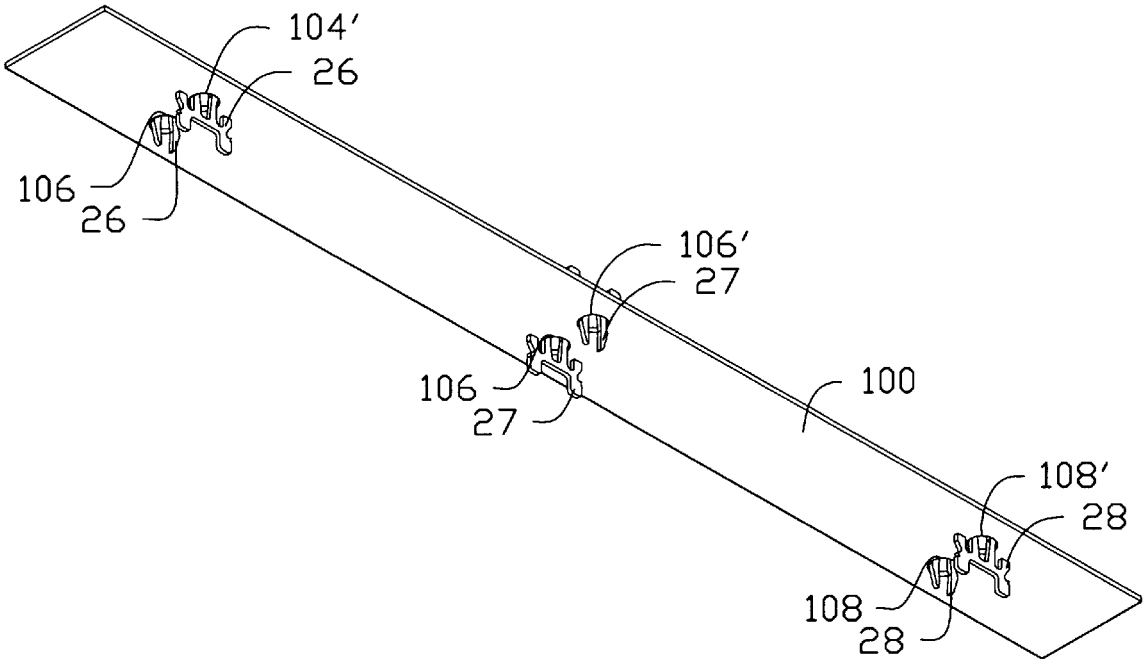
FIG. 4 is a perspective view of the PC board and the boardlocks of the connectors of FIG. 2 to show how the boardlocks respectively engage the corresponding holes.
Figure 5:
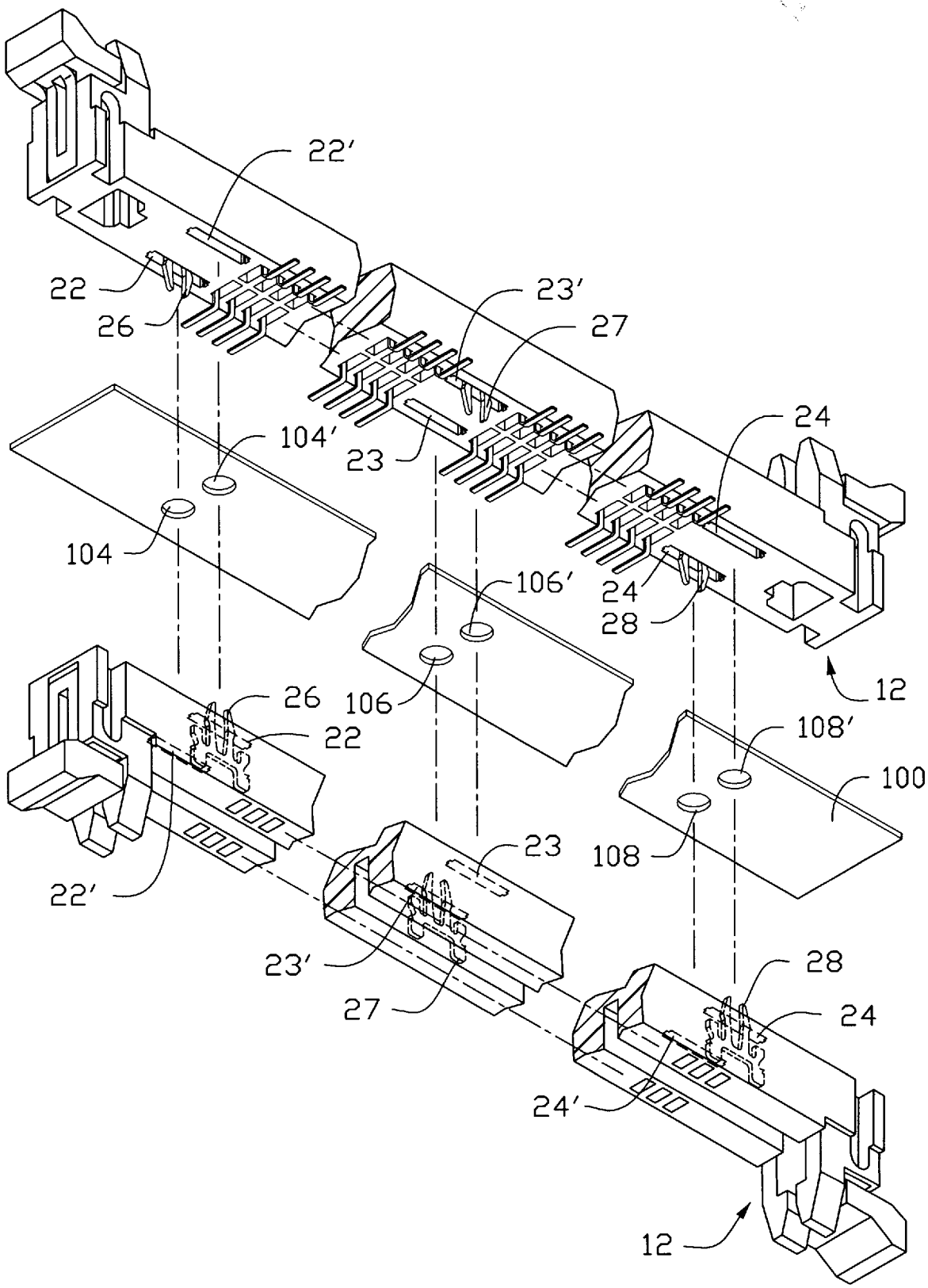
FIG. 5 is an exploded perspective view of the connectors of FIG. 1 and the PC board of FIG. 4 to show how the boardlocks are aligned with the corresponding holes in the PC board.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–5 wherein an electrical connector assembly 10 includes a pair of identical connectors 12 each including an elongated housing 14 defining a central slot 16 for receiving a module (not shown) therein.

Two rows of passageways 18 are provided by two sides of the central slot 16 for receiving a corresponding number of contacts 19 therein, respectively. A pair of ejectors 20 are provided on two ends of the housing 14 for ejecting the inserted module (not shown) from the housing 14.

Three pairs of apertures 22, 22', 23, 23', 24 and 24' are provided on the bottom surface 25 of the housing 14 wherein two pairs of apertures 22, 22', 24 and 24' are located adjacent two opposite ends of the housing 14 and the third pair of apertures 23 and 23' are located near the middle portion of the housing 14, and wherein the apertures 22, 23 and 24 are positioned close to the first side wall 17 while the aperture 22', 23' and 24' are positioned close to the second side wall 15. Three boardlocks 26, 27 and 28 are staggeringly and respectively positioned in three apertures 22, 23' and 24.

Correspondingly, the PC board 100 reserves a specific region 102 for attachment of the connectors 12 thereto from two opposite sides (surfaces). Three pairs of holes 104, 104', 106, 106', 108 and 108' are provided therewith wherein two pairs are located adjacent to two ends thereof and one pair is located near the middle portion thereof.

When assembled, the first connector 12 is attached to the first surface 110 of the PC board 100 from one side whereby the boardlocks 26, 27 and 28 of the first connector 12 are respectively inserted into the corresponding holes 104, 106' and 108 in the PC board. Successively, the second connector 12 is attached to the second surface 112 of the PC board 100 from the other side whereby the boardlock 26, 27 and 28 of the second connector 12 are respectively inserted into the corresponding apertures 104', 106 and 108' in the PC board 100.

Under this situation, the tips of the boardlocks 26, 27 and 28 of the first upper connector 12 may be received within the apertures 22', 23 and 24' in the second lower connector 12. Similarly, the tips of the boardlocks 26, 27 and 28 of the second lower connector 12 may be received within the apertures 22', 23 and 24' in the first upper connector 12.

It can be understood that because the dimension of each hole 104, 104', 106, 106', 108 and 108' is so small, each pair of holes 104/104', 106/106' and 108/108' may be unified as one section and shaped like number "8". It will be an equivalent way to the previous embodiment of the invention. It is also noted that in this embodiment each pair of holes 104/104', 106/106' and 108/108' are arranged in a transverse direction perpendicular to the lengthwise direction along the housing, while they also can be arranged along the lengthwise direction along the housing to comply with the pair of holes in the PC board wherein such pair of holes are arranged in a lengthwise direction.

Figure 6:
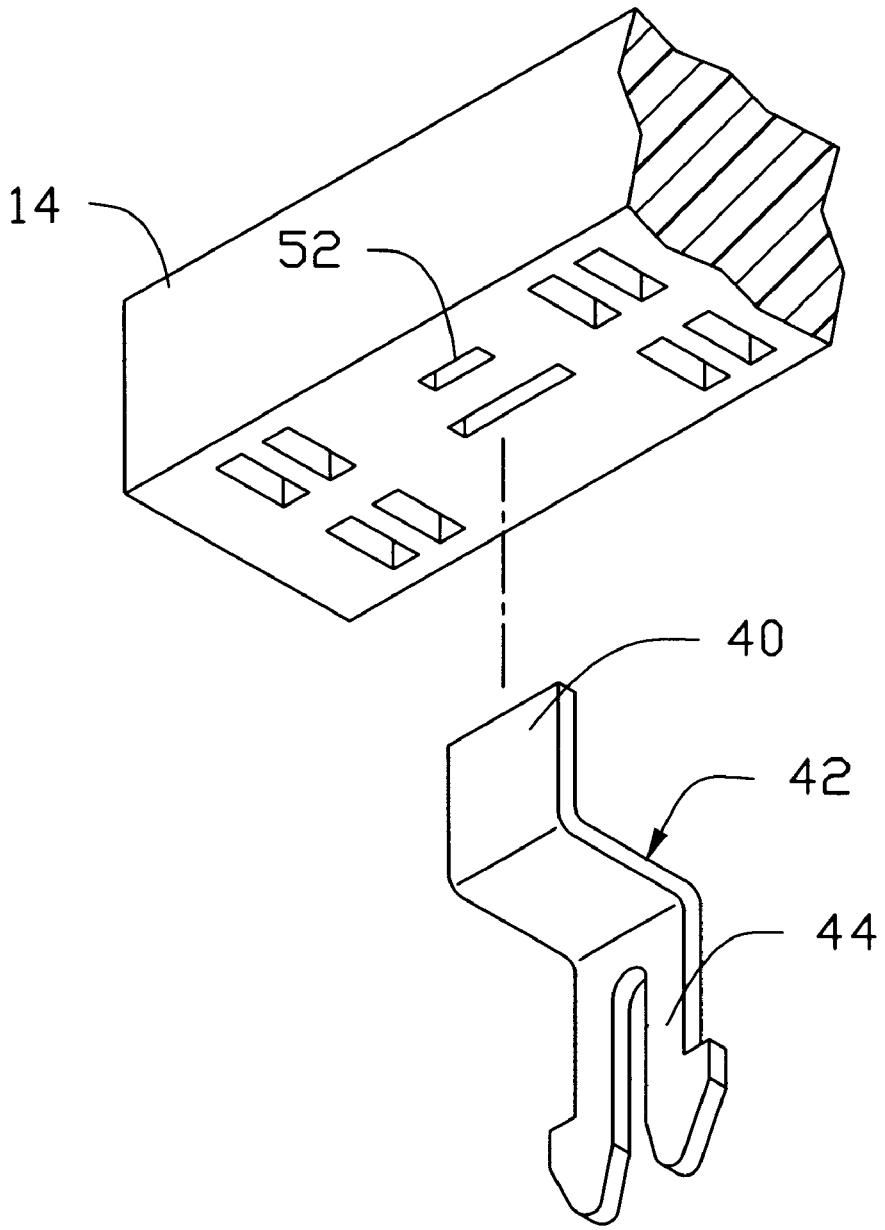
FIG. 6 is a fragmentary perspective view of another embodiment of the connector having an offset boardlock thereof.

FIG. 6 shows another embodiment wherein the retention portion 40 of the boardlock 42 is disposed along the center line of the housing 14 while the leg portion 44 of the boardlock 42 is offset to one side wall for compliance with the hole in the PC board 100. The bottom surface 50 of the housing 14 includes a recession region 52 for receiving the tips of the boardlocks 42 of opposite connector extending into the recession region 52 from another side of the board 100.

We claim:

1. A system for mounting two identical connectors onto two sides of a PC board, each of said connectors including an elongate housing defining a first side wall and a second side wall with at least two boardlocks respectively positioned in the housing, each of said boardlocks having a leg section wherein the leg section of one of said boardlocks is proximate the first side wall and the leg section of the other of said boardlocks is proximate the second side wall; the PC board including a predetermined region forming a first side edge and a second side edge, said two connectors being adapted to be mounted on opposite surfaces of the PC board within said region, at least first and second pairs of holes defined through said region whereby the two boardlocks of one of said connectors are respectively received within one of the first pair of holes proximate the first side edge and one of the second pair of holes proximate the second side edge, and the two boardlocks of the other of said connectors are respectively received within the other of the first pair of holes proximate the second side edge and the other of the second pair of holes proximate the first side edge.

2. The system as defined in claim 1, wherein the connector further includes at least two pairs of apertures and for each pair of apertures, one aperture is adapted to receive a retention section of the corresponding boardlock and the other aperture is adapted to receive the tip of a leg section of the boardlock of the opposite connector.

3. A method for mounting two devices to the same region of a board on opposite surfaces thereof, the steps comprising:

providing each of said devices with at least two boardlocks on an undersurface of a housing thereof, each boardlock being offset from a center longitudinal line of the housing;

providing at least two pairs of receiving sections in the board;

positioning one of said devices to the board from one surface thereof and having said boardlocks received within two receiving sections in the board; and positioning the other of said devices to the board from the other surface thereof and having said boardlocks received within the remaining two receiving sections in the board.

4. The method as defined in claim 3, wherein one of said boardlocks of one of said devices proximate one side wall of the housing and the other of said boardlocks of the same one of said devices is proximate the other side wall of the housing, the boardlocks not being located on a same transverse plane.

5. A system for mounting two devices on opposite surfaces of a board, each of said devices including a housing with a plurality of contacts received therein for surface-mounting to one side of the board, and at least one boardlock extending downward from a bottom surface of the housing and through the board, the boardlocks being positioned proximate each other and the board defining a pair of receiving sections for the extension of said boardlocks therethrough, wherein a tip of said boardlock can be accommodated within a space provided by a bottom portion of the complementary connector positioned on the other side of the board.

6. The system as defined in claim 5, wherein the boardlocks of said devices are arranged in a transverse direction with regard to the housing.

7. A system for respectively mounting a first and a second devices on opposite surfaces of a board, each of said devices including a housing and at least two boardlocks respectively positioned on two longitudinally spaced sections thereof, each of said boardlocks extending through the board, wherein the boardlock positioned adjacent to a first section of the first device is proximate but offset from the boardlock positioned adjacent to a first section of the second device, and the boardlock positioned adjacent to a second section of the first device is proximate but offset from the boardlock positioned adjacent to a second section of the second device.

8. The system as defined in claim 7, wherein a space is provided around a bottom portion adjacent to the second section of the second device for receiving a tip of said boardlock extending from the first device adjacent to the second section thereof, and another space is provided in a bottom portion adjacent to the first section of the first device for receiving a tip of said boardlock extending from the second device adjacent to the first section thereof.

9. The system as defined in claim 7, wherein a space is provided in a bottom portion adjacent to the first section of the second device for receiving a tip of said boardlock extending from the first device adjacent to the first section thereof, and another space is provided in a bottom portion adjacent the second section of the first device for receiving a tip of said boardlock extending from the second device adjacent to the second section thereof.

10. The system as defined in claim 7, wherein the board defines a pair of closely spaced receiving sections respectively corresponding to the boardlock adjacent to the first section of the first device and the other boardlock adjacent to the first section of the second device.

* * * * *